US010272709B2

(12) United States Patent
Niu et al.

(10) Patent No.: US 10,272,709 B2
(45) **Date of Patent: *Apr. 30, 2019**

(54) COATED PRINT MEDIA

(71) Applicant: Hewlett-Packard Development Company, L.P., Fort Collins, CO (US)

(72) Inventors: Bor-Jiunn Niu, San Diego, CA (US); Tao Chen, San Diego, CA (US); Haigang Chen, San Diego, CA (US); Haowen Yu, San Diego, CA (US); Silke Courtenay, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/539,940

(22) PCT Filed: Jan. 23, 2015

(86) PCT No.: PCT/US2015/012719
§ 371 (c)(1),
(2) Date: Jun. 26, 2017

(87) PCT Pub. No.: WO2016/118161
PCT Pub. Date: Jul. 28, 2016

(65) Prior Publication Data

US 2017/0368861 A1 Dec. 28, 2017

(51) Int. Cl.
*B41M 5/52* (2006.01)

(52) U.S. Cl.
CPC ..... *B41M 5/5254* (2013.01); *B41M 5/52* (2013.01); *B41M 5/5245* (2013.01);
(Continued)

(58) Field of Classification Search
CPC .... B41M 5/0017; B41M 5/5218; B41M 5/52; B41M 5/5227; B41M 5/5236;
(Continued)

(56) References Cited

U.S. PATENT DOCUMENTS 6,492,005 B1 12/2002 Ohbayashi et al.
6,977,100 B2 12/2005 Kondo et al.
(Continued)

FOREIGN PATENT DOCUMENTS

CN 103757989 4/2014
KR 1020150000823 1/2015

OTHER PUBLICATIONS

International Search Report and Written Opinion dated Oct. 19, 2015 for PCT/US2015/012719, Applicant Hewlett Packard Development Company, L.P.

*Primary Examiner* — Jannelle M Lebron
(74) *Attorney, Agent, or Firm* — Thorpe North & Western LLP

(57) ABSTRACT

The present disclosure is drawn to coated print media, a method of preparing print media, and a printing system. The coated print media can comprise a substrate and a coating applied to the substrate. The coating can include, by dry weight, 5 wt % to 60 wt % of a polymeric binder having a Tg below 50 C, 10 wt % to 60 wt % of cationic latex having a Tg from 50 C to 130 C, 5 wt % to 30 wt % of a multivalent cationic salt, and 2 wt % to 25 wt % of a high density polyethylene wax.

20 Claims, 1 Drawing Sheet

(52) U.S. Cl.
CPC ..... *B41M 5/5218* (2013.01); *B41M 5/5227* (2013.01); *B41M 5/5236* (2013.01)

(58) Field of Classification Search
CPC ... B41M 5/5245; B41M 5/5254; C09D 11/16; C09D 11/38; C09D 11/00; C09D 11/322; C09D 11/40; C09D 11/54; B41J 11/0015
USPC ..... 347/21, 101
See application file for complete search history.

(56) References Cited

U.S. PATENT DOCUMENTS

| | | | | |
|---|---|---|---|---|
| 6,991,330 | B2 | 1/2006 | Maekawa | |
| 7,361,399 | B2 | 4/2008 | Song et al. | |
| 8,053,044 | B2 | 11/2011 | Zhou et al. | |
| 8,092,873 | B2 | 1/2012 | Wang et al. | |
| 8,092,874 | B2 | 1/2012 | Wexler et al. | |
| 8,541,070 | B2 | 9/2013 | Wang et al. | |
| 8,685,503 | B2 | 4/2014 | Zhou et al. | |
| 8,709,555 | B2 | 4/2014 | Pal et al. | |
| 8,727,528 | B2 | 5/2014 | Romano, Jr. | |
| 8,765,852 | B1 | 7/2014 | Swei et al. | |
| 8,821,997 | B2 | 9/2014 | Romano, Jr. et al. | |
| 8,821,998 | B2 | 9/2014 | Romano | |
| 9,962,984 | B2 * | 5/2018 | Niu | B41M 5/52 |
| 9,981,497 | B2 * | 5/2018 | Niu | B41M 5/52 |
| 2005/0031806 | A1 | 2/2005 | Kim et al. | |
| 2005/0225618 | A1 | 10/2005 | Askeland et al. | |
| 2011/0091666 | A1 | 4/2011 | Wang et al. | |
| 2011/0250404 | A1 | 10/2011 | Pervan et al. | |
| 2012/0236095 | A1 | 9/2012 | Pal et al. | |
| 2013/0293647 | A1 | 11/2013 | Dannhauser et al. | |
| 2014/0168337 | A1 | 6/2014 | Wingkono et al. | |
| 2014/0302292 | A1 | 10/2014 | Romano | |
| 2014/0363593 | A1 * | 12/2014 | Liestman | B41M 5/52 428/32.52 |

* cited by examiner

COATED PRINT MEDIA

BACKGROUND

There are several reasons that inkjet printing has become a popular way of recording images on various media surfaces, particularly paper. Some of these reasons include low printer noise, variable content recording, capability of high speed recording, and multi-color recording. Additionally, these advantages can be obtained at a relatively low price to consumers. However, though there has been great improvement in inkjet printing, accompanying this improvement are increased demands by consumers in this area, e.g., higher speeds, higher resolution, full color image formation, increased stability, etc. Additionally, inkjet printing technology is becoming more prevalent in high speed commercial printing markets. Regardless of the platform, achieving or maintaining a high image quality can be challenging. Coated media typically used for inkjet printing can perform acceptably with certain printing devices, but there is much more specialty media used for specific types of printers than in the past, and there is still room for improvement as it relates to image quality. As such, research and development of media continue to be sought.

DETAILED DESCRIPTION

Figure 1:
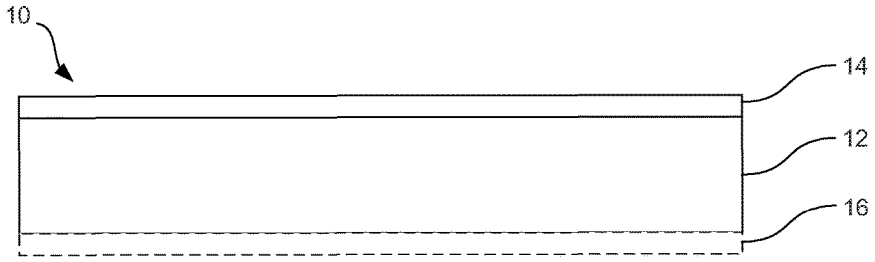
FIG. 1 is a cross-sectional view of a coated print medium in accordance with examples of the present disclosure.

Before the present disclosure is described, it is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited only by the appended claims and equivalents thereof.

Obtaining high print quality for various inks on uncoated paper can sometimes be a challenge. In accordance with the present disclosure, coatings can be applied to various media substrates, including paper, that provide acceptable image quality, including optical density increase, image gloss increase, durability improvement, and/or color gamut improvement. More specifically, low glass transition temperature (Tg) polymeric binder (below 50° C.), high Tg cationic latex (50° C. to 130° C.), multivalent cationic salt, and high density polyethylene wax can be used to prepare a coating that, particularly when calendered under heat and pressure, provides image gloss, print quality and durability improvement.

In accordance with this, the present disclosure is drawn to a print medium including a substrate and a coating applied to the substrate, either on one side or on both sides of the substrate. The coating can include, by dry weight, 5 wt % to 60 wt % of a polymeric binder having a Tg below 50° C., 10 wt % to 60 wt % of cationic latex having a Tg from 50° C. to 130° C., 5 wt % to 30 wt % of a multivalent cationic salt, and 2 wt % to 25 wt % of a high density polyethylene wax. In one example, the coating can further be modified with the application of an ink, and the ink and coating can be heat and pressure fused at from 150° C. to 250° C. and from 1000 psi to 3000 psi.

In another example, a method of preparing a coated print medium can include applying a coating composition to a media substrate, the coating composition including water, polymeric binder having a Tg below 50° C., cationic latex having a Tg from 50° C. to 130° C., multivalent cationic salt, and high density polyethylene wax. Another step can include applying heat and pressure to the coating composition applied to the media substrate to yield a 0.5 to 10 gsm dry coating on the media substrate, comprising, by dry weight, 5 wt % to 60 wt % of the polymeric binder, 10 wt % to 60 wt % of the cationic latex, 5 wt % to 30 wt % of the multivalent cationic salt, and 2 wt % to 25 wt % of the high density polyethylene wax.

In another example, a printing system can include an ink, a coated print medium, and a calendering device. The coated print medium can include a substrate and a coating applied to the substrate. The coating can include, by dry weight, 5 wt % to 60 wt % of a polymeric binder having a Tg below 50° C., 10 wt % to 60 wt % of cationic latex having a Tg from 50° C. to 130° C., 5 wt % to 30 wt % of a multivalent cationic salt, and 2 wt % to 25 wt % of a. The system can also include a calendering device for applying heat and pressure to the coated print medium after the ink is printed on the coated print medium.

In these examples, it is noted that when discussing the coated print medium, the method of making the same, or the printing system, each of these descriptions can be considered applicable to all of these examples, whether or not they are explicitly discussed in the context of that example. Thus, for example, in discussing details about the coated print medium per se, applicable discussion also refers to the methods or systems described herein, and vice versa.

Turning now to FIG. 1, a coated print medium 10 is shown, which can include a coating applied to one 14 or both 14,16 sides of a substrate 12. The coating weight can range from 0.5 gsm to 10 gsm, or in other examples, from 1 gsm to 6 gsm, or from 1.5 gsm. To 4 gsm. Thus, the print medium, method of preparing the print medium, and the printing system can each include a substrate with the coating applied thereto.

The substrate is typically a base or foundational material or coated medium, e.g., in the form of a sheet, roll, etc., that is coated in accordance with examples of the present disclosure. The substrate can be, without limitation, a polymer substrate, a conventional paper substrate, a photobase substrate, an offset coated media substrate, or the like. As mentioned, in one aspect of the present disclosure, the coatings herein can be applied to substrates that are already pre-coated with another material, such as offset coated media. To illustrate, the substrate can be a raw, pre-coated base having an offset coating applied at from 2 gsm to 40 gsm. Exemplary offset or other coatings that can be present on offset media include media with clay carbonate coatings, precipitated calcium carbonate coatings, calcined clay coatings, silica pigment-based coatings, combinations thereof, or the like.

As a point of clarification, it is noted that certain coatings (or pre-coatings) described herein may already be present as part of a substrates, and these coatings are not the same as formulation coatings primarily discussed in the context of the present disclosure. Offset media or photobase, for example, already include coatings on one or both side of a substrate material (and thus are considered to be part of the "substrate"). The coating formulations of the present disclosure, conversely, are those which are overcoated with respect to the pre-applied coatings, or alternatively, to substrates that are not already pre-coated. Such coatings, i.e. the pre-coating and/or the coating formulation of the present disclosure, can be present on either one side of a media substrate or both.

Turning now more specifically to the coating formulations of the present disclosure, as mentioned, such coatings include, by solids content (dry weight), 5 wt % to 60 wt % of a polymeric binder having a Tg below 50° C., 10 wt % to 60 wt % of cationic latex having a Tg from 50° C. to 130° C., 5 wt % to 30 wt % of a multivalent cationic salt, and 2 wt % to 25 wt % of a high density polyethylene wax. The solids are typically prepared in a liquid vehicle which is evaporated or dried off to leave the coating solids behinds as a dry coating on the substrate. The liquid vehicle, which is usually primarily water or can be only water, typically includes from 25 wt % to 60 wt % of the initial coating formulation. That being stated, the weight percentages listed for the coating composition recite the weights after the liquid vehicle has been dried or evaporated from the coating composition.

Turning now to specific ingredient that can be present in the coating applied to the media substrate, polymeric binder having a glass transition temperature (Tg) less than 50° C., can be present and used to bind the materials of the coating together, but can also provide other print quality advantages, e.g., provide improved bleed control. In one specific aspect of the present disclosure, the polymeric binder can be a water soluble polymer binder, though this is not required. To illustrate, the polymeric binder can be any hydrophilic or hydrophilic/hydrophobic blend of polymer material that can be used to bind particulates together in accordance with examples of the present disclosure. By "water soluble," it is noted that the polymer binder is typically at least partially water soluble, mostly water soluble (at least 50%), or in some examples, completely water soluble (at least 99%) in the coating composition. Polyvinyl alcohol, polyvinyl pyrrolidone, starch, low Tg latex having a glass transition temperature (Tg) ranging from −20° C. to 20° C., and protein are examples of acceptable water soluble polymer binders that can be used. Examples of starch binders that can be used include Penford® Gums, such as Penford® 280 (hydroxyethylated starch), available from Penford Corporation. Examples of a low Tg latexes that can be used as a binder are the Neocar® latexes, such as Neocar® 2300 (vinyl versatate-containing latex), among others. Examples of a polyvinyl alcohol binders that can be used include Mowiol® PVOH binders, e.g., Mowiol® 4-98 available from Kuraray.

In some aspects, in combination with the polymeric binder, a crosslinker or crosslinking agent can be included in the coating formulations of the present disclosure. Crosslinkers include materials that have crosslinking properties specifically with respect to the water soluble polymer binder used in a given coating composition. Suitable crosslinkers include boric acid, ammonium zirconium carbonate (AZC), potassium zirconum carbonate (KZC), and OCHCHO (glyoxal). More specifically, in some examples, boric acid is an acceptable crosslinker for polyvinyl alcohol, and in other examples, AZC, KZC, and glyoxal are acceptable crosslinkers for proteins and starches. In one example, non-acidic crosslinkers, such as a blocked glyoxal-based insolubilizer (e.g., Curesan® 200 from BASF) can be used to crosslink the water soluble binder, and these are particularly useful when the anionic non-film forming polymer particulates are also being used. Crosslinkers, if present, are usually present at relatively small concentrations in the coating composition, e.g., from 0.01 wt % to 5 wt % of the formulation, and in many instances, the crosslinkers are more typically present at a ratio of 1:100 to 1:4 crosslinker to binder by weight, though these concentrations and ratios are not intended to be limiting.

The cationic latex, which can be in the form of plastic pigment particles, can range in glass transition temperature from 50° C. to 130° C. in one example, and in another example, the cationic latex can be a high Tg cationic latex ranging from 70° C. to 120° C. Such materials can include materials such as Raycat® 82 from Specialty Polymers, Inc. (acrylic emulsion polymer, solids 40 wt %, pH 4.5, and glass transition temperature 25° C.), Raycat® 29033 (styrene/acrylic copolymer, solids 40 wt %, pH 5.0, and glass transition temperature 77° C.), or Raycat® 78 (polyacrylic emulsion polymer, solids 40 wt %, pH 5.5, and glass transition temperature 115° C.). More generally and in accordance with another example, the cationic latex can be an acrylic emulsion polymer, a styrene acrylic copolymer, a styrene methacrylic copolymer, a polyacrylic emulsion polymer, ethylene acrylic copolymer, ethylene methacrylic copolymer, or combinations thereof. These exemplary cationic latexes are examples of suitable materials that can be used herein, but it is noted that other materials currently available or available in the future that meet the criteria of being a cationic latex can also be used.

Turning now to the multivalent cationic salt, various types of salts can be used in the media coatings of the present disclosure. Often, the salt can be, for example, calcium chloride, magnesium chloride, calcium bromide, magnesium bromide, calcium nitrate, magnesium nitrate, magnesium sulfate, or aluminum chlorohydrate. These salts can act as crashing agent for pigment-based inkjet inks. Thus this additive can provide versatility to the coated media in that other ingredients can assist in providing improved image quality for dye-based inks, whereas the presence of the multivalent salt can assist with image quality when a pigmented inkjet ink is used.

High density polyethylene wax (HDPE) can also be included. Commercially available waxes that can be used include Michemshield® 29235 from Michelman, Inc., and Ultralube® E846 or D806 from Keim Additec Surface GmbH, for example. In certain examples, the HDPE can have an average particle size from 500 nm to 30 μm or from 1 μm to 10 μm, a density from 0.9 g/cc to 1.0 g/cc or from 0.93 g/cc to 0.97 g/cc, and/or a melting point from 110° C. to 150° C. or 125° C. to 135° C. HDPE is useful for the coatings of the present technology because of its strength-to-density ratio, due in part to its very low branching and higher density and crystallinity. These properties provide strong intermolecular forces and tensile strength, more so than low density polyethylene (LDPE).

Other additives can also be present, such as cationic or anionic inorganic pigments. For example, the inorganic pigments can be added at from 0.1 wt % to 35 wt %, by solids content (dry weight). Examples of such inorganic pigments include anionic calcium carbonate, cationic calcium carbonate, or clay. More specific examples of calcium carbonates that can be used include Hydrocarb® 60, from Omya North America, which is an anionic calcium carbonate; or Micronasize® CAT, from Specialty Products, Inc., which is a cationic calcium carbonate. Optical brighteners can also be included at from 0.01 wt % to 15 wt %, by solids content (dry weight). Slip aids can also be included that contribute to abrasion resistance and coefficient of friction (COF) reduction. Lubricants, thickeners, biocides, defoamers, buffering agents, CMS, and surfactants can also be added in minor amounts as well, e.g., from 0.01 wt % to 5 wt % if present. Fillers can also be included in minor amounts, e.g., from 0.01 wt % to 5 wt %, including materials such as clays, barium sulfate, titanium dioxide, silica, aluminum trihydrate, aluminum oxide, boehmite, and combinations thereof. Again, these materials are optional and considered fillers, and if added, should not detract from the functional characteristics of the coating formulation as a whole.

Figure 2:
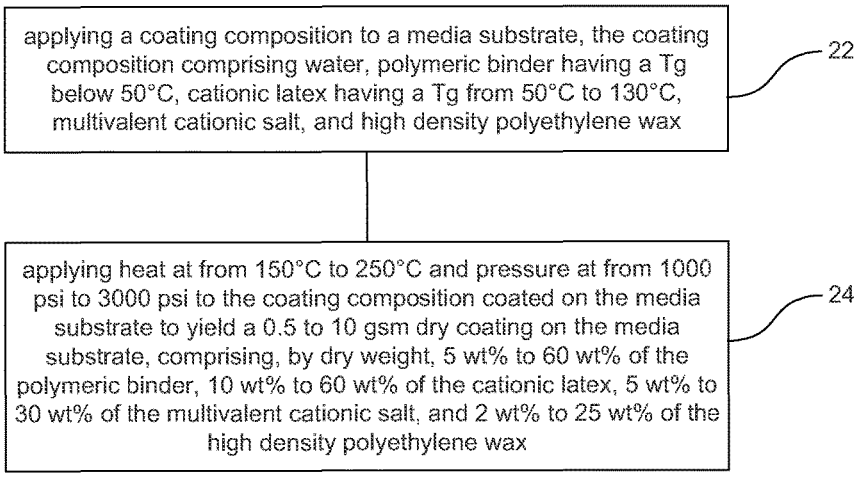
FIG. 2 is a flow chart representation of a method in accordance with examples of the present disclosure.

Once the formulation is prepared, the coating can be applied to the substrate by any of a number of coating methods. Thus, turning now to FIG. 2, in examples of the present disclosure, a method of preparing a print medium can include applying 22 a coating composition to a media substrate, the coating composition including water, polymeric binder having a Tg below 50° C., cationic latex having a Tg from 50° C. to 130° C., multivalent cationic salt, and high density polyethylene wax. Another step can include applying 24 heat and pressure to the coating composition coated on the media substrate to yield a 0.5 to 10 gsm dry coating on the media substrate, comprising, by dry weight, 5 wt % to 60 wt % of the polymeric binder, 10 wt % to 60 wt % of the cationic latex, 5 wt % to 30 wt % of the multivalent cationic salt, and 2 wt % to 25 wt % of the high density polyethylene wax. In one example, the heat can be applied at from 150° C. to 250° C., and the pressure is applied at from 1000 psi to 3000 psi. In another example, a drying step can be carried out after applying the coating composition. The drying step removes water and other volatiles that may be present prior to applying heat and pressure to the coating composition coated on the media substrate. In another example, the method can include printing an ink on the coating composition applied to the media substrate prior to applying heat and pressure.

Figure 3:
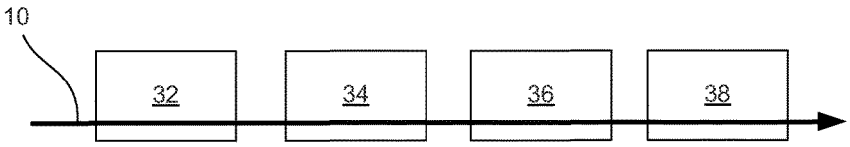
FIG. 3 is a schematic representation of a printing system in accordance with examples of the present disclosure.

In FIG. 3, a schematic representation of specific printing system for preparing a print medium 10, printing thereon, and calendering after printing is shown. The system can include the print medium, ink, and a calendering device 38. In further detail, the system can include a coating composition applicator 32 and a dryer 34 to prepare the print medium 10 for printing. Printing of the ink on the print medium occurs at a printing device 36. Once printed, the coating and the ink printed thereon can be calendered in the calendering device (under heat and pressure). This system can be set up as an inline system (all four devices 32, 34, 36, 38 set up in-line), or various components can be separated and carried out off-line (partially in-line system or each device operates off-line separately). For example, the print medium can be prepared using an in-line coating applicator/dryer prior to loading into an in-line printing/calendering device. Alternatively, an in-line coating applicator/printer can be used with a separate calendering device (with or without a dryer). Any combination of in-line and individual off-line devices can be used to generate prints as described with respect to this system.

In accordance with examples of the present disclosure, the substrate can be coated using the coating applicator as described above. The coating applicator can be set up for spray coating, dip coating, cascade coating, roll coating, gravure coating, curtain coating, air knife coating, cast coating, Mayer rod coating, blade coating, film coating, metered size press coating, puddle size press coating, calender stack, and/or by using other known coating techniques. The thickness selected for each coated layer can depend upon the particular desired property or application. However, an advantage of the formulations of the present disclosure is that they can be applied relatively thinly compared to many other commercially available coating compositions. To illustrate, in one example, the coating can be applied at a coat weight from 0.5 gsm to 10 gsm. In another example, the coating can be applied to the substrate at a coat weight from 1 gsm to 6 gsm. More typical coat weights for comparative media that does not include the components of the present disclosure are usually in the order of about 15 gsm or greater, so a thinner coating with provide acceptable image quality and smudge resistance can be particularly advantageous.

Any drying device (or in some cases, ambient drying can be used without the use of a dryer device) can be used to dry the coating once applied to the substrate. Suitable drying devices can include forced air dryers, heated dryers, IR heaters, or combinations thereof.

Any printing device that applies ink to the coated print medium can be used, such as a thermal inkjet printer, a piezo inkjet printer, or the like. In one specific example, the printer can be a web press printer, such as HP T200 series, T300 series, or T400 series Color Inkjet Web Presses. Web Press devices print very rapidly and thus, the coating applications described herein can be prepared so that they are suitable for very fast coating, drying, printing, and/or calendering. These coating layers can, for example, deliver acceptable image quality at high printing speed greater than 400 feet/min (fpm) with HP Web Presses.

Once dried and printed, in one example, the coated print medium can be passed between a pair of heated rollers as part of a calendering process. As mentioned, calendering can be carried out in-line or with a larger system, or off-line in a separate device. The calendering device can be a separate super-calendering machine, an on-line, soft-nip calendering machine, an off-line, soft-nip calendering machine, or the like.

Using this process, prints can be prepared that have a desirable image gloss and gloss uniformity. For example, the cationic latex, or plastic pigment, under heat and pressure can form a continuous film. The printed ink can thus be integrated into the film resulting in a very smooth surface with good gloss uniformity, e.g., high gloss for unprinted areas and printed areas alike. Durability of the printed image can also be enhanced with dry smear resistance and wet rubbing resistance improvements. Also, in accordance with the present disclosure, the ink colorant can become anchored to the coating layer after printing, and then become encapsulated by calendering due to the heat and pressure applied thereto.

It is noted that, as used in this specification and the appended claims, the singular forms "a," "an," and "the" include plural referents unless the content clearly dictates otherwise.

"Substrate" or "media substrate" includes any base material that can be coated in accordance with examples of the present disclosure, such as film base substrates, polymer substrates, conventional paper substrates, photobase substrates, offset media substrates, and the like. Further, precoated and film coated substrates can be considered a "substrate" that can be further coated in accordance with examples of the present disclosure.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt % to about 20 wt % should be interpreted to include not only the explicitly recited limits of 1 wt % and about 20 wt %, but also to include individual weights such as 2 wt %, 11 wt %, 14 wt %, and sub-ranges such as 10 wt % to 20 wt %, 5 wt % to 15 wt %, etc.

EXAMPLES

The following examples illustrate some of the coated media substrates, systems, and methods that are presently known. However, it is to be understood that the following are only exemplary or illustrative of the application of the principles of the present compositions, systems, and methods. Numerous modifications and alternative compositions, systems, and methods may be devised by those skilled in the art without departing from the spirit and scope of the present disclosure. The appended claims are intended to cover such modifications and arrangements. Thus, while the examples have been described above with particularity, the following provide further detail in connection with what are presently deemed to be the acceptable examples.

Example 1

Several coating formulations were prepared in accordance with Table 1 (expressed in parts by weight, dry):

TABLE 1

| Coating Formulations | | | | |
|---|---|---|---|---|
| | Formula 1 Dry Wt % | Formula 2 Dry Wt % | Formula 3 Dry Wt % | Formula 4 Dry Wt % |
| $CaCl_2$ (multivalent cationic salt) | 30 | 15 | 36 | 40 |
| Raycat ® 78 (115° C. Tg, acrylic emulsion cationic latex polymer) | 32.5 | 53.5 | 15 | — |
| Ultralube ® D-806 (HDPE Wax) | 12.5 | 11.5 | 12 | 22 |
| Mowiol ® 4-98 (Polyvinyl Alcohol; >98% hydrolysis, 27,000 Mw) | 10 | 10 | — | — |
| PrintRite ® DP 595 (Acrylate latex binder) | 15 | 10 | — | — |
| Ecosphere 2202D (Starch binder) | — | — | 7 | 22 |
| Resyn 1190 (Polyvinyl acetate latex binder) | — | — | 30 | — |

TABLE 1-continued

| Coating Formulations | | | | |
|---|---|---|---|---|
| | Formula 1 Dry Wt % | Formula 2 Dry Wt % | Formula 3 Dry Wt % | Formula 4 Dry Wt % |
| Neocar ® 2300 (Polyvinyl acetate-acrylate-versatate latex binder) | — | — | — | 16 |

These coating formulations can be prepared using various preparative methods, with various liquid vehicles, and adding ingredients using various orders of addition. To illustrate, in one example, the order of addition of ingredients can be water (which is not shown above because dry wt % is provided above after removal of water), cationic latex polymer, multivalent cationic salt, polymeric binder (polyvinyl alcohol, starch, or low Tg latex in these examples), and high density polyethylene wax, for example. Other orders of addition can be used as well.

Example 2

Each of the coatings of Example 1 (Formulations 1-4) can be applied to one side or both sides of a media substrate, such as paper, and dried so that the solvent or liquid vehicle components are removed. It is noted the liquid vehicle in Tables 1 is not listed because Formulas 1-4 are provided in dry weight. That being stated, the liquid vehicle which is removed by drying can be primarily water with or without other small amounts of other volatile ingredients that can be readily removed upon drying. The remaining dry weight can typically be from 0.5 gsm to 10 gsm. In the present example, coating formulations of Tables 1 were overcoated on single side of a plain paper print media substrate using a blade coater to produce a dry coating weight of about 1 gsm.

In accordance with this, four media sample types were prepared and printed on using a dye-based inkjet ink set, and some samples were calendered at 100° C. and 1500 psi. Additionally, for comparison purposes, AC Utopia book paper 45# media was tested as well. Each of the samples were specifically tested for sheet gloss (gloss of unprinted portion) and image gloss (gloss of printed portion) to give a delta gloss (or gloss difference). Lower gloss difference is typically considered better because the gloss is more uniform over the entire page. Also tested was color gamut, black optical density (KOD), L*min, and print durability. Coating 1 (C1) represents Formula 1 coated at 1 gsm on single side of a paper media substrate; coating 2 (C2) represents Formula 2 coated at 1 gsm on single side of a paper media substrate; and so forth. AC is AC Utopic Book Paper 45# without any of the formulation coatings (C1-C4) applied thereto. With color gamut and black optical density, a larger number is better indicating more color gamut and more optical density for the inkjet inks printed thereon. Additionally, a lower value for L*min is a better value, as it indicates high black color density. The durability values were collected visually after various rubbing tests, including rubbing printed image samples with a Sutherland 2000 Rub Tester with the ASTM F1571-95 standard test method. A scale of 1 to 5 was used, with 5 being the highest durability value, and thus the best durability. A value of less than 4 is considered less desirable, whereas 4 or better has excellent durability. In these examples, HP A50 color pigmented inkjet ink, which is a water-based inkjet ink, was printed on the various coated media and either dried, or dried and calendered. All of these data points are assembled in Tables 2A and 2B below.

TABLE 2A

| Coating | Calendered | Sheet Gloss | Image Gloss | Δ Gloss |
|---|---|---|---|---|
| 1 | no | 50 | 58 | 8 |
| 1 | yes | 77 | 98 | 21 |
| 2 | no | 57 | 63 | 6 |
| 2 | yes | 85 | 99 | 14 |
| 3 | no | 73 | 66 | −7 |
| 3 | yes | 84 | 94 | 10 |
| 4 | no | 50 | 63 | 13 |
| 4 | yes | 77 | 81 | 4 |
| AC | no | 19 | 23 | 4 |
| AC | yes | 31 | 46 | 15 |

TABLE 2B

| Coating | Calendered | Color Gamut | KOD | L*min | Durability |
|---|---|---|---|---|---|
| 1 | no | 213K | 1.49 | 20.2 | 2 |
| 1 | yes | 259K | 1.8 | 13.7 | 4.5 |
| 2 | no | 238K | 1.46 | 21.1 | 2 |
| 2 | yes | 245K | 1.63 | 14.9 | 4.5 |
| 3 | no | 279K | 1.66 | 16.7 | 2 |
| 3 | yes | 290K | 1.96 | 10.7 | 4.5 |
| 4 | no | 256K | 1.68 | 18 | 1.5 |
| 4 | yes | 268K | 1.7 | 15.6 | 3 |
| AC | no | 192K | 1.31 | 26.3 | 3 |
| AC | yes | 208K | 1.39 | 23 | 3.5 |

As can be seen from Tables 2A and 2B, the presence of cationic salt, high density polyethylene wax, and binder provides acceptable print results in some categories (see calendered coating 4), but by adding the high Tg cationic latex, as in coatings 1-3, the calendered coating increases in durability to greater than 4. Additionally, it is noted that calendered image gloss for coatings 1-3 is also superior to the calendered image gloss of coating 4. Each of coatings 1-3 also provide improved image quality and durability generally compared to the comparative AC Utopia media.

While the disclosure has been described with reference to certain examples, those skilled in the art will appreciate that various modifications, changes, omissions, and substitutions can be made without departing from the spirit of the disclosure. It is intended, therefore, that the disclosure be limited only by the scope of the following claims.

What is claimed is:

1. A coated print medium, comprising:
a substrate; and
a coating applied to the substrate, comprising, by dry weight:
5 wt % to 60 wt % of a polymeric binder having a Tg below 50° C.,
10 wt % to 60 wt % of cationic latex having a Tg from 50° C. to 130° C.,
5 wt % to 30 wt % of a multivalent cationic salt, and
2 wt % to 25 wt % of a high density polyethylene wax.

2. The print medium of claim 1, wherein the coating includes an ink applied thereto.

3. The print medium of claim 2, wherein coating with the ink applied thereto is heat and pressure fused at from 150° C. to 250° C. and from 1000 psi to 3000 psi.

4. The print medium of claim 1, wherein the substrate is uncoated or precoated and comprises a polymer substrate, a paper substrate, a photobase substrate, a film coated substrate, or an offset media substrate.

5. The print medium of claim 1, wherein the polymeric binder is starch, polyvinyl alcohol, polyvinyl pyrrolidone, polyvinyl acetate −20° C. to 20° C. Tg latex, protein, or combination thereof.

6. The print medium of claim 1, wherein the cationic latex is a plastic pigment.

7. The print medium of claim 1, wherein the cationic latex is an acrylic emulsion polymer, a styrene acrylic copolymer, a styrene methacrylic copolymer, a polyacrylic emulsion polymer, ethylene acrylic copolymer, ethylene methacrylic copolymer, or combination thereof.

8. The print medium of claim 1, wherein the multivalent cationic salt is calcium chloride, magnesium chloride, calcium bromide, magnesium bromide, calcium nitrate, magnesium nitrate, magnesium sulfate, aluminum chlorohydrate, or combination thereof.

9. The print medium of claim 1, wherein the high density polyethylene wax has an average particle size from 500 nm to 30 μm, a density from 0.9 g/c$^3$ to 1.0 g/c$^3$, and a melting point from 110° C. to 150° C.

10. The print medium of claim 1, wherein the coating is applied to the substrate at a coat weight from 0.5 gsm to 10 gsm by dry weight on a single side or both sides.

11. A method of preparing a coated print medium, comprising:
applying a coating composition to a media substrate, the coating composition comprising water, polymeric binder having a Tg below 50° C., cationic latex having a Tg from 50° C. to 130° C., multivalent cationic salt, and high density polyethylene wax; and
applying heat at from 150° C. to 250° C. and pressure at from 1000 psi to 3000 psi to the coating composition coated on the media substrate to yield a 0.5 to 10 gsm dry coating on the media substrate, comprising, by dry weight, 5 wt % to 60 wt % of the polymeric binder, 10 wt % to 60 wt % of the cationic latex, 5 wt % to 30 wt % of the multivalent cationic salt, and 2 wt % to 25 wt % of the high density polyethylene wax.

12. The method of claim 11, further comprising drying after applying the coating composition to the media substrate, wherein the drying step removes a water and other volatiles that may be present prior to applying heat and pressure to the coating composition coated on the media substrate.

13. The method of claim 11, further comprising printing an ink on the coating composition applied to the media substrate prior to applying heat and pressure.

14. A printing system, comprising:
an ink;
a coated print medium, comprising:
a substrate;
a coating applied to the substrate, comprising, by dry weight:
5 wt % to 60 wt % of a polymeric binder having a Tg below 50° C.,
10 wt % to 60 wt % of cationic latex having a Tg from 50° C. to 130° C.,
5 wt % to 30 wt % of a multivalent cationic salt, and
2 wt % to 25 wt % of a high density polyethylene wax; and
a calendering device for applying heat and pressure to the coated print medium after the ink is printed on the coated print medium.

15. The printing system of claim 14, further comprising a coating composition applicator to apply the coating to the substrate, a dryer to dry the coating after application to form the coated print medium, and a printer to apply the ink to the coated print medium.

16. The printing system of claim 14, wherein the substrate is uncoated or precoated and comprises a polymer substrate, a paper substrate, a photobase substrate, a film coated substrate, or an offset media substrate.

17. The printing system of claim 14, wherein the polymeric binder is starch, polyvinyl alcohol, polyvinyl pyrrolidone, polyvinyl acetate −20° C. to 20° C. Tg latex, protein, or combination thereof.

18. The printing system of claim 14, wherein the cationic latex is a plastic pigment, an acrylic emulsion polymer, a styrene acrylic copolymer, a styrene methacrylic copolymer, a polyacrylic emulsion polymer, ethylene acrylic copolymer, ethylene methacrylic copolymer, or combination thereof; and wherein the multivalent cationic salt is calcium chloride, magnesium chloride, calcium bromide, magnesium bromide, calcium nitrate, magnesium nitrate, magnesium sulfate, aluminum chlorohydrate, or combination thereof.

19. The printing system of claim 14, wherein the high density polyethylene wax has an average particle size from 500 nm to 30 μm, a density from 0.9 $g/c^3$ to 1.0 $g/c^3$, and a melting point from 110° C. to 150° C.

20. The printing system of claim 14, wherein the coating is applied to the substrate at a coat weight from 0.5 gsm to 10 gsm by dry weight on a single side or both sides.

* * * * *